US011649136B2

(12) United States Patent
Witczak et al.

(10) Patent No.: US 11,649,136 B2
(45) Date of Patent: May 16, 2023

(54) CONVEYANCE APPARATUS LOCATION DETERMINATION USING PROBABILITY

(71) Applicant: OTIS ELEVATOR COMPANY, Farmington, CT (US)

(72) Inventors: Tadeusz Pawel Witczak, Farmington, CT (US); Nikola Trcka, West Hartford, CT (US); Lindsay Wos, Avon, CT (US); Oleh Shvets, Poznań (PL); Andrzej Bohonos, Swiebodzin (PL); Lukasz Majchrzak, Sieraków (PL); Pawel Drzycimski, Poznań (PL)

(73) Assignee: OTIS ELEVATOR COMPANY, Farmington, CT (US)

( * ) Notice: Subject to any disclaimer, the term of this patent is extended or adjusted under 35 U.S.C. 154(b) by 1138 days.

(21) Appl. No.: 16/266,297

(22) Filed: Feb. 4, 2019

(65) Prior Publication Data

US 2020/0247643 A1 Aug. 6, 2020

(51) Int. Cl.
*B66B 1/34* (2006.01)
*B66B 5/00* (2006.01)

(52) U.S. Cl.
CPC ..... *B66B 1/3492* (2013.01); *B66B 5/0006* (2013.01); *B66B 5/0031* (2013.01)

(58) Field of Classification Search
CPC ..... B66B 5/0012; B66B 1/3423; B66B 3/02; B66B 1/24; B66B 2201/211; B66B 3/002;
(Continued)

(56) References Cited

U.S. PATENT DOCUMENTS 4,493,399 A 1/1985 Kajiyama
4,700,810 A 10/1987 Otala
(Continued)

FOREIGN PATENT DOCUMENTS

CN 101356108 A * 1/2009 ..... B66B 1/34
CN 203976158 U 12/2014
(Continued)

OTHER PUBLICATIONS

The Extended European Search Report for Application No. 19214935.9-1017; Report dated Jun. 19, 2020; Report Received Date: Oct. 7, 2020; 5 pages.
(Continued)

*Primary Examiner* — Marlon T Fletcher
(74) *Attorney, Agent, or Firm* — Cantor Colburn LLP

(57) ABSTRACT

A method of monitoring a conveyance apparatus within a conveyance system is provided. The method including: obtaining a starting location position probability distribution of the conveyance apparatus within the conveyance system; detecting motion of the conveyance apparatus away from the probable starting location for a period of time; determining a distance traveled by the conveyance apparatus during the period of time; determining a direction of motion of the conveyance apparatus during the period of time; and determining a probability of the conveyance apparatus being at each of a plurality of possible destination locations at a conclusion of the period of time in response to the starting location position probability distribution and at least one of the distance traveled, the direction of motion, and the period of time.

20 Claims, 5 Drawing Sheets

(58) Field of Classification Search
CPC ..... B66B 1/3492; B66B 2201/00; B66B 2201/30; B66B 5/0006; B66B 1/28; B66B 2201/403; B66B 5/0037; B66B 5/0018; B66B 2201/20; B66B 2201/402; B66B 3/00; B66B 13/14; B66B 2201/225; B66B 2201/226; B66B 1/3415; B66B 2201/214; B66B 1/34
See application file for complete search history.

(56) References Cited

U.S. PATENT DOCUMENTS

| | | | | |
|---|---|---|---|---|
| 4,940,117 | A | 7/1990 | Ovaska | |
| 7,484,598 | B2 * | 2/2009 | Tyni | B66B 5/0025 187/291 |
| 7,699,143 | B2 | 4/2010 | Tschuemperlin et al. | |
| 8,540,057 | B2 | 9/2013 | Schuster | |
| 8,678,143 | B2 | 3/2014 | Bunter | |
| 8,863,908 | B2 | 10/2014 | Villa et al. | |
| 9,033,114 | B2 * | 5/2015 | Mizon | B66B 1/3492 187/394 |
| 9,950,899 | B2 | 4/2018 | Mattsson et al. | |
| 2016/0272460 | A1 | 9/2016 | Simcik et al. | |
| 2016/0304313 | A1 * | 10/2016 | Kinnari | B66B 1/3492 |
| 2017/0253461 | A1 * | 9/2017 | Villa | B66B 1/44 |
| 2017/0349399 | A1 | 12/2017 | Sonnenmoser et al. | |
| 2017/0355555 | A1 | 12/2017 | Ginsberg et al. | |
| 2018/0265328 | A1 | 9/2018 | Patel et al. | |
| 2020/0247643 | A1 * | 8/2020 | Witczak | B66B 5/0006 |
| 2020/0262678 | A1 * | 8/2020 | Chou | B66B 1/2466 |

FOREIGN PATENT DOCUMENTS

| | | | | | |
|---|---|---|---|---|---|
| CN | 104030121 | B | | 6/2016 | |
| CN | 105668360 | A | | 6/2016 | |
| CN | 104828661 | B | | 8/2016 | |
| CN | 106144862 | A | * | 11/2016 | B66B 1/3461 |
| CN | 205709297 | U | | 11/2016 | |
| CN | 104743418 | B | | 2/2017 | |
| CN | 106395520 | A | * | 2/2017 | B66B 1/14 |
| CN | 106516922 | A | | 3/2017 | |
| CN | 104936879 | B | | 4/2017 | |
| CN | 206842767 | U | | 1/2018 | |
| CN | 108249239 | A | | 7/2018 | |
| CN | 109110598 | A | | 1/2019 | |
| DE | 19911402 | A1 | | 9/2000 | |
| DE | 102016123410 | A1 | | 6/2018 | |
| EP | 2489621 | A1 | | 8/2012 | |
| EP | 3081519 | A1 | | 2/2018 | |
| JP | 2004155554 | A | | 6/2004 | |
| WO | 2018177829 | A1 | | 10/2018 | |

OTHER PUBLICATIONS

Chinese Office Action for Application No. 201911410279.X; dated Nov. 26, 2021; 9 Pages.
European Search Report for Application No. 19214935.9; dated Jul. 10, 2020; 5 Pages.
Chinese Office Action for Application No. 201911410279.X; dated Aug. 3, 2022; 10 Pages.

* cited by examiner

CONVEYANCE APPARATUS LOCATION DETERMINATION USING PROBABILITY

BACKGROUND

The embodiments herein relate to the field of conveyance systems, and specifically to a method and apparatus for monitoring a conveyance apparatus of a conveyance system.

Conveyance systems, such as, for example, elevator systems, escalator systems, and moving walkways may require periodic monitoring to perform diagnostics.

BRIEF SUMMARY

According to an embodiment, a method of monitoring a conveyance apparatus within a conveyance system is provided. The method including: obtaining a starting location position probability distribution of the conveyance apparatus within the conveyance system; detecting motion of the conveyance apparatus away from the probable starting location for a period of time; determining a distance traveled by the conveyance apparatus during the period of time; determining a direction of motion of the conveyance apparatus during the period of time; and determining a probability of the conveyance apparatus being at each of a plurality of possible destination locations at a conclusion of the period of time in response to the starting location position probability distribution and at least one of the distance traveled, the direction of motion, and the period of time.

In addition to one or more of the features described herein, or as an alternative, further embodiments may include that determining a distance traveled by the conveyance apparatus during the period of time further includes: detecting an acceleration of the conveyance apparatus during the period of time; and determining the distance travelled by the conveyance apparatus in response to the acceleration and the period of time.

In addition to one or more of the features described herein, or as an alternative, further embodiments may include that determining a distance traveled by the conveyance apparatus during the period of time further includes: obtaining a velocity of the conveyance apparatus during the period of time; and determining the distance travelled by the conveyance apparatus in response to the velocity of the conveyance apparatus and the period of time.

In addition to one or more of the features described herein, or as an alternative, further embodiments may include that obtaining a velocity of the conveyance apparatus during the period of time further includes: detecting a velocity of the conveyance apparatus during the period of time.

In addition to one or more of the features described herein, or as an alternative, further embodiments may include that the direction of motion of the conveyance apparatus is determined in response to the acceleration of the conveyance apparatus detected during the period of time.

In addition to one or more of the features described herein, or as an alternative, further embodiments may include that determining a distance traveled by the conveyance apparatus during the period of time further includes: detecting a first air pressure at the probable starting location of the conveyance apparatus; detecting a second air pressure at the conclusion of the period of time; and determining the distance travelled by the conveyance apparatus in response to the first air pressure and the second air pressure.

In addition to one or more of the features described herein, or as an alternative, further embodiments may include: activating an alert when the probability of the conveyance apparatus being at each of a plurality of possible destination locations at a conclusion of the period of time is less than a selected probability.

In addition to one or more of the features described herein, or as an alternative, further embodiments may include that the conveyance system is an elevator system and the conveyance apparatus is an elevator car.

In addition to one or more of the features described herein, or as an alternative, further embodiments may include: determining the probable destination location, wherein the probable destination location is a possible destination location of the plurality of possible destination locations having the probability that is highest amongst the plurality of possible destination locations.

According to another embodiment, a sensing apparatus for monitoring a conveyance apparatus within a conveyance system is provided. The sensing apparatus including: a processor; and a memory including computer-executable instructions that, when executed by the processor, cause the processor to perform operations. The operations including: determining a starting location position probability distribution of the conveyance apparatus within the conveyance system; detecting motion of the conveyance apparatus away from the probable starting location for a period of time; determining a distance traveled by the conveyance apparatus during the period of time; determining a direction of motion of the conveyance apparatus during the period of time; and determining a probability of the conveyance apparatus being at each of a plurality of possible destination locations at a conclusion of the period of time in response to starting location position probability distribution and at least one of the distance traveled, the direction of motion, and the period of time.

In addition to one or more of the features described herein, or as an alternative, further embodiments may include that determining a distance traveled by the conveyance apparatus during the period of time further includes: detecting an acceleration of the conveyance apparatus during the period of time; and determining the distance travelled by the conveyance apparatus in response to the acceleration and the period of time.

In addition to one or more of the features described herein, or as an alternative, further embodiments may include that determining a distance traveled by the conveyance apparatus during the period of time further includes: obtaining a velocity of the conveyance apparatus during the period of time; and determining the distance travelled by the conveyance apparatus in response to the velocity of the conveyance apparatus and the period of time.

In addition to one or more of the features described herein, or as an alternative, further embodiments may include that obtaining a velocity of the conveyance apparatus during the period of time further includes: detecting a velocity of the conveyance apparatus during the period of time.

In addition to one or more of the features described herein, or as an alternative, further embodiments may include that the direction of motion of the conveyance apparatus is determined in response to the acceleration of the conveyance apparatus detected during the period of time.

In addition to one or more of the features described herein, or as an alternative, further embodiments may include that determining a distance traveled by the conveyance apparatus during the period of time further includes: detecting a first air pressure at the probable starting location of the conveyance apparatus; detecting a second air pressure at the conclusion of the period of time; and determining the distance travelled by the conveyance apparatus in response to the first air pressure and the second air pressure.

In addition to one or more of the features described herein, or as an alternative, further embodiments may include that the operations further include: activating an alert when the probability of the conveyance apparatus being at each of a plurality of possible destination locations at a conclusion of the period of time is less than a selected probability.

In addition to one or more of the features described herein, or as an alternative, further embodiments may include that the conveyance system is an elevator system and the conveyance apparatus is an elevator car.

In addition to one or more of the features described herein, or as an alternative, further embodiments may include that the operations further include: determining the probable destination location, wherein the probable destination location is a possible destination location of the plurality of possible destination locations having the probability that is highest amongst the plurality of possible destination locations.

According to another embodiment, a computer program product tangibly embodied on a computer readable medium is provided. The computer program product including instructions that, when executed by a processor, cause the processor to perform operations including: determining a starting location position probability distribution of the conveyance apparatus within the conveyance system; detecting motion of the conveyance apparatus away from the probable starting location for a period of time; determining a distance traveled by the conveyance apparatus during the period of time; determining a direction of motion of the conveyance apparatus during the period of time; and determining a probability of the conveyance apparatus being at each of a plurality of possible destination locations at a conclusion of the period of time in response to starting location position probability distribution and at least one of the distance traveled, the direction of motion, and the period of time.

In addition to one or more of the features described herein, or as an alternative, further embodiments may include that determining a distance traveled by the conveyance apparatus during the period of time further includes: detecting an acceleration of the conveyance apparatus during the period of time; and determining the distance travelled by the conveyance apparatus in response to the acceleration and the period of time.

Technical effects of embodiments of the present disclosure include determining a probability that a conveyance apparatus of a conveyance system is at a possible destination location based upon distance that the conveyance apparatus has travelled.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Conveyance systems, such as, for example, elevator systems, escalator systems, and moving walkways may require periodic monitoring to perform diagnostics using a variety of sensors. The sensors may be one way sensing apparatus that only communicate data rather than receiving data, thus saving power. Such sensing apparatus may require a location of the conveyance system to supplement detected data and must detect the location of the conveyance system by itself. When tracking the location of the conveyance apparatus through a one-way sensing apparatus, the tracked location may become uncertain at times and embodiments disclosed herein seek to address this issue.

Figure 1:
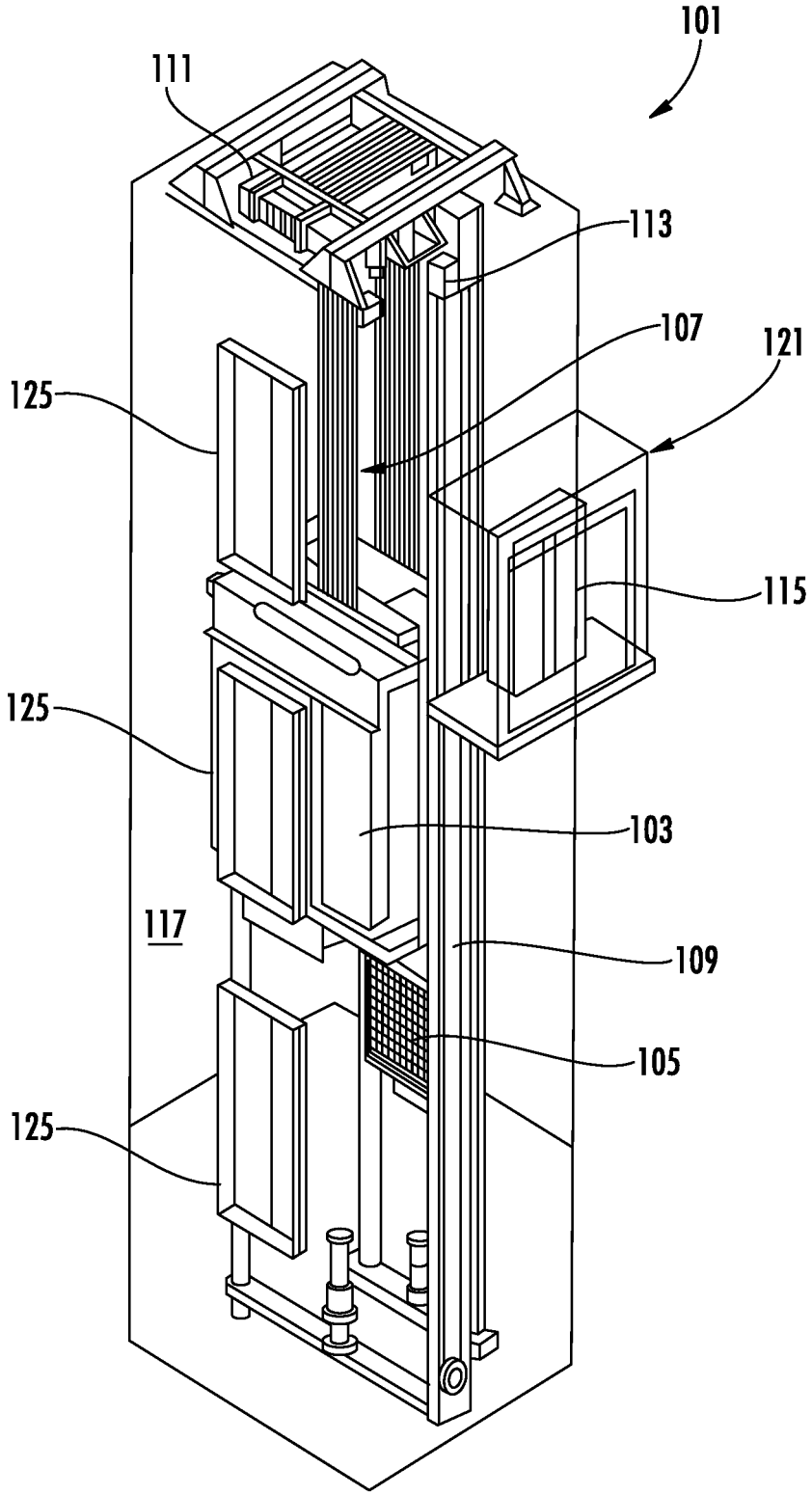
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

In other embodiments, the system comprises a conveyance system that moves passengers between floors and/or along a single floor. Such conveyance systems may include escalators, people movers, etc. Accordingly, embodiments described herein are not limited to elevator systems, such as that shown in FIG. 1. In one example, embodiments disclosed herein may be applicable conveyance systems such as an elevator system 101 and a conveyance apparatus of the conveyance system such as an elevator car 103 of the elevator system 101. In another example, embodiments disclosed herein may be applicable conveyance systems such as an escalator system and a conveyance apparatus of the conveyance system such as a moving stair of the escalator system.

Figure 2:
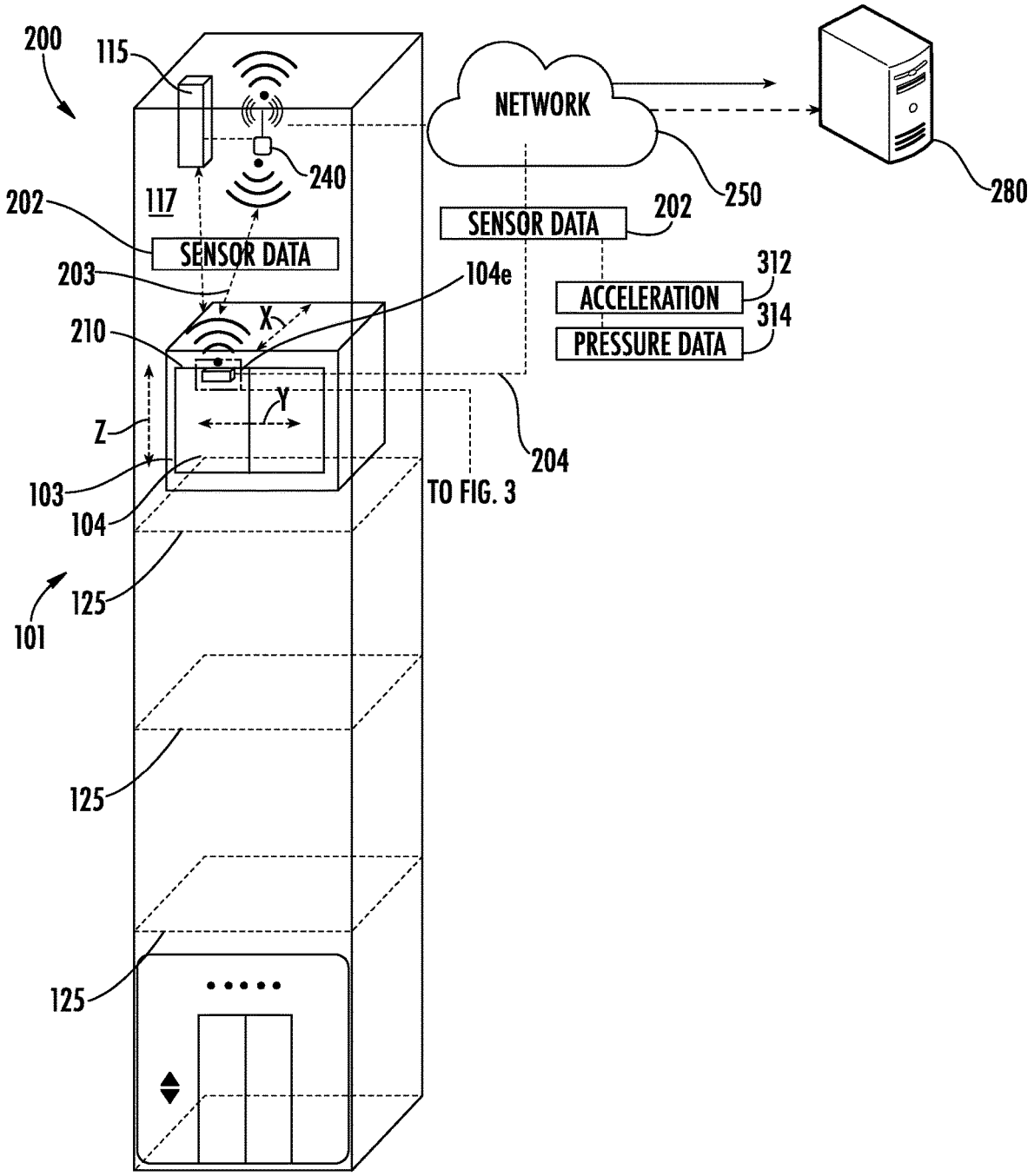
FIG. 2 is a schematic illustration of a sensor system for the elevator system of FIG. 1, in accordance with an embodiment of the disclosure.

FIG. 2 is a view of a sensor system 200 including a sensing apparatus 210, according to an embodiment of the present disclosure. The sensing apparatus 210 is configured to detect sensor data 202 of the elevator car 103 and transmit the sensor data 202 to a remote device 280. Sensing data 202 may include but is not limited to pressure data 314, vibratory signatures (i.e., vibrations over a period of time) or accelerations 312 and derivatives or integrals of accelerations 312 of the elevator car 103, such as, for example, distance, velocity, jerk, j ounce, snap . . . etc. Sensing data 202 may also include light, sound, humidity, and temperature, or any other desired data parameter. The pressure data 314 may include atmospheric air pressure within the elevator shaft 117. In an embodiment, the sensing apparatus 210 is configured to transmit sensor data 202 that is raw and unprocessed to the controller 115 of the elevator system 101 for processing. In another embodiment, the sensing apparatus 210 is configured to process the sensor data 202 prior to transmitting the sensor data 202 to the controller 115. In another embodiment, the sensing apparatus 210 is configured to transmit sensor data 202 that is raw and unprocessed to a remote system 280 for processing. In yet another embodiment, the sensing apparatus 210 is configured to process the sensor data 202 prior to transmitting the sensor data 202 to the remote device 280.

The processing of the sensor data 202 may reveal data, such as, for example, a number of elevator door openings/closings, elevator door time, vibrations, vibratory signatures, a number of elevator rides, elevator ride performance, elevator flight time, probable car position (e.g. elevation, floor number), releveling events, rollbacks, elevator car 103 *x, y* acceleration at a position: (i.e., rail topology), elevator car 103 *x, y* vibration signatures at a position: (i.e., rail topology), door performance at a landing number, nudging event, vandalism events, emergency stops, etc.

The remote device 280 may be a computing device, such as, for example, a desktop or cloud computer. The remote device 280 may also be a mobile computing device that is typically carried by a person, such as, for example a smartphone, PDA, smartwatch, tablet, laptop, etc. The remote device 280 may also be two separate devices that are synced together, such as, for example, a cellular phone and a desktop computer synced over an internet connection. The remote device 280 may also be a cloud computing network.

The sensing apparatus 210 is configured to transmit the sensor data 202 to the controller 115 or the remote device 280 via short-range wireless protocols 203 and/or long-range wireless protocols 204. Short-range wireless protocols 203 may include but are not limited to Bluetooth, Wi-Fi, HaLow (801.11ah), zWave, Zigbee, or Wireless M-Bus. Using short-range wireless protocols 203, the sensing apparatus 210 is configured to transmit the sensor data 202 to directly to the controller 115 or to a local gateway device 240 and the local gateway device 240 is configured to transmit the sensor data 202 to the remote device 280 through a network 250 or to the controller 115. The network 250 may be a computing network, such as, for example, a cloud computing network, cellular network, or any other computing network known to one of skill in the art. Using long-range wireless protocols 204, the sensing apparatus 210 is configured to transmit the sensor data 202 to the remote device 280 through a network 250. Long-range wireless protocols 204 may include but are not limited to cellular, satellite, LTE (NB-IoT, CAT M1), LoRa, Satellite, Ingenu, or SigFox.

The sensing apparatus 210 may be configured to detect sensor data 202 including acceleration in any number of directions. In an embodiment, the sensing apparatus may detect sensor data 202 including accelerations 312 along three axis, an X axis, a Y axis, and a Z axis, as show in in FIG. 2. The X axis may be perpendicular to the doors 104 of the elevator car 103, as shown in FIG. 2. The Y axis may be parallel to the doors 104 of the elevator car 103, as shown in FIG. 2. The Z axis may be aligned vertically parallel with the elevator shaft 117 and pull of gravity, as shown in FIG. 2. Vibratory signatures may be generated along the X-axis and the Y-axis as the elevator car 103 moves along the Z-axis.

Figure 3:
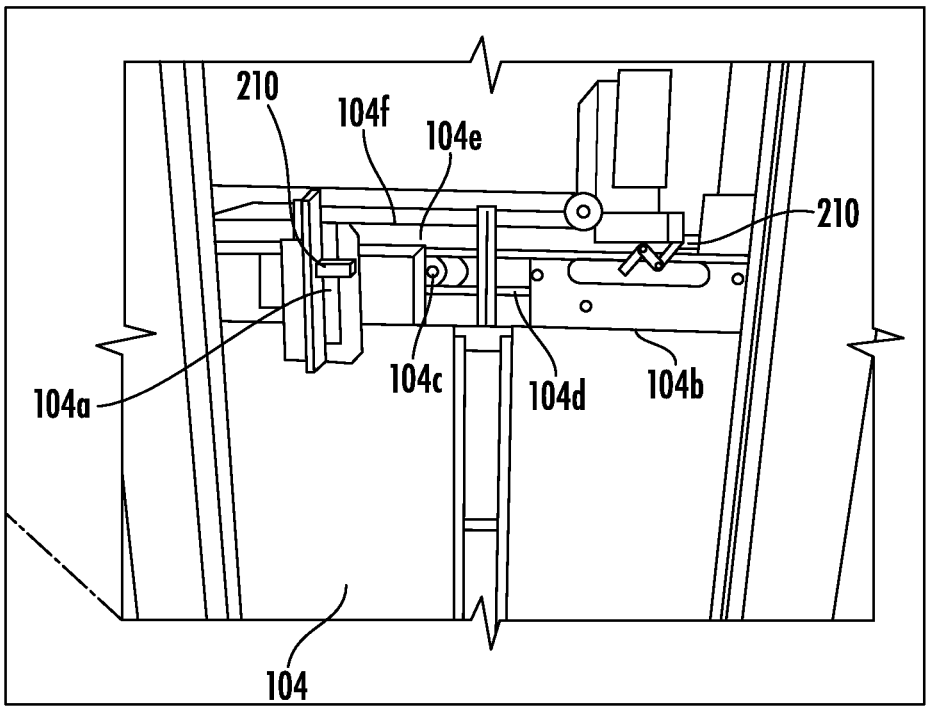
FIG. 3 is a schematic illustration of the location of sensing apparatus of the sensor system of FIG. 2, in accordance with an embodiment of the disclosure.

FIG. 3 shows a possible installation location of the sensing apparatus 210 within the elevator system 101. In the illustrated embodiment shown in FIG. 3, the sensing apparatus 210 may be installed on the door hanger 104*a* of the elevator system 101. It is understood that the sensing apparatus 210 may also be installed in other locations other than the door hanger 104*a* of the elevator system 101. In another embodiment, the sensing apparatus 210 may be attached to a door header 104*e* of a door 104 of the elevator car 103. In another embodiment, the primary sensing apparatus 201 may be located on a door header 104*e* proximate a top portion 104*f* of the elevator car 103. In another embodiment, the sensing apparatus 210 is installed elsewhere on the elevator car 103, such as, for example, directly on the door 104.

As shown in FIG. 3, the sensing apparatus 201 may be located on a door hanger 104*a*. The doors 104 are operably connected to the door header 104*e* through a door hanger 104*a* located proximate a top portion 104*b* of the door 104. The door hanger 104*a* includes guide wheels 104*c* that allow the door 104 to slide open and close along a guide rail 104*d* on the door header 104*e*. Advantageously, the door hanger 104*a* is an easy to access area to attach the sensing apparatus 210 because the door hanger 104*a* is accessible when the elevator car 103 is at landing 125 and the elevator door 104 is open. Thus, installation of the sensing apparatus 210 is possible without taking special measures to take control over the elevator car 103. For example, the additional safety of an emergency door stop to hold the elevator door 104 open is not necessary as door 104 opening at landing 125 is a normal operation mode. The door hanger 104*a* also provides ample clearance for the sensing apparatus 210 during operation of the elevator car 103, such as, for example, door 104 opening and closing. Due to the mounting location of the sensing apparatus 210 on the door hanger 104*a*, the sensing apparatus 210 may detect open and close motions (i.e., acceleration) of the door 104 of the elevator car 103 and a door at the landing 125. Additionally mounting the sensing apparatus 210 on the hanger 104*a* allows for recording of a ride quality of the elevator car 103.

Figure 4:
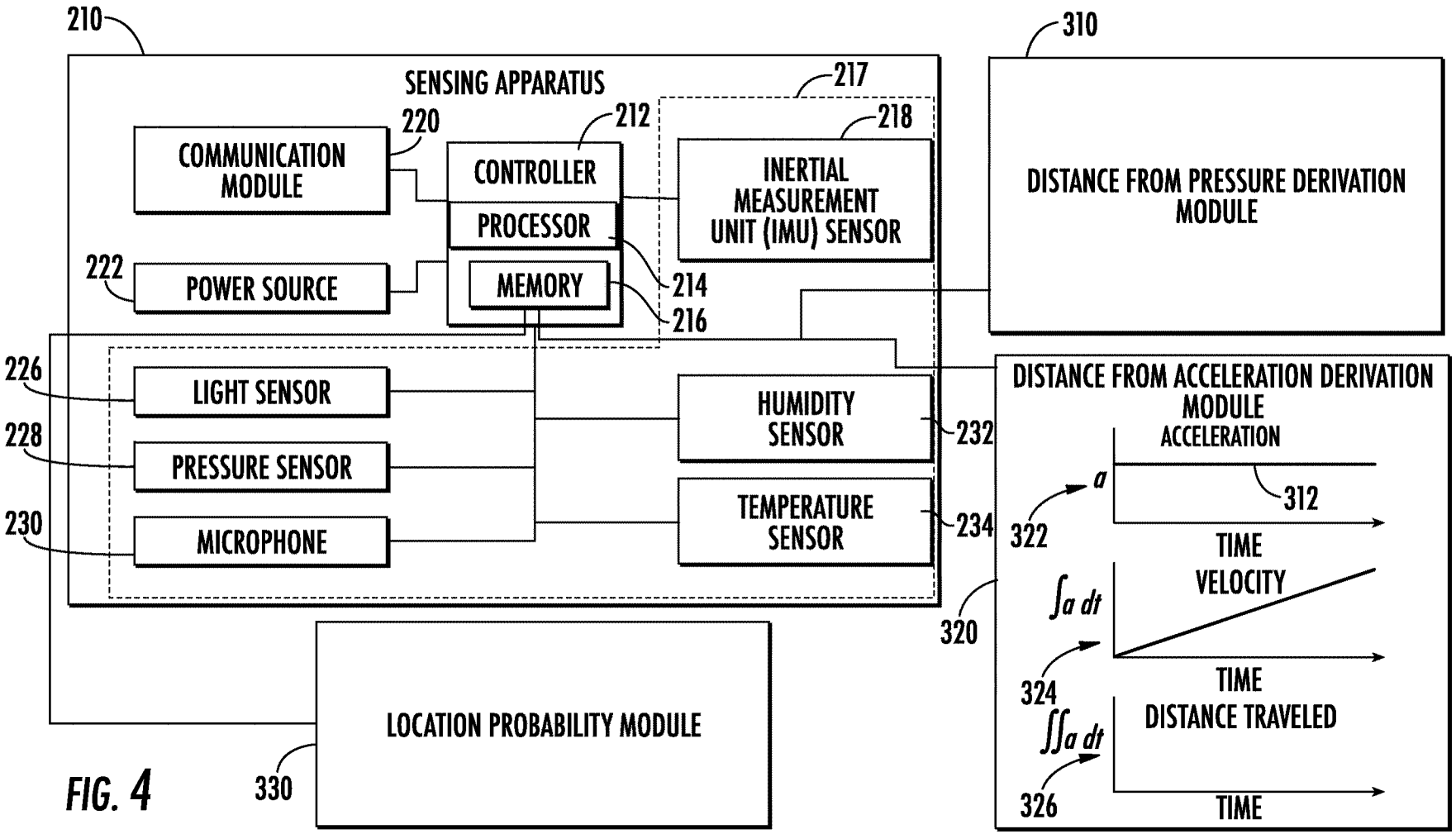
FIG. 4 is a schematic illustration of a sensing apparatus of the sensor system of FIG. 2, in accordance with an embodiment of the disclosure.

FIG. 4 illustrates a block diagram of the sensing apparatus 210 of the sensing system of FIGS. 2 and 3. It should be appreciated that, although particular systems are separately defined in the schematic block diagram of FIG. 4, each or any of the systems may be otherwise combined or separated via hardware and/or software. As shown in FIG. 4, the sensing apparatus 210 may include a controller 212, a plurality of sensors 217 in communication with the controller 212, a communication module 220 in communication with the controller 212, and a power source 222 electrically connected to the controller 212.

The plurality of sensors 217 may include an inertial measurement unit (IMU) sensor 218 configured to detect sensor data 202 including accelerations 312 of the sensing apparatus 210 and the elevator car 103 when the sensing apparatus 210 is attached to the elevator car 103. The IMU sensor 218 may be a sensor, such as, for example, an accelerometer, a gyroscope, or a similar sensor known to one of skill in the art. The accelerations 312 detected by the IMU sensor 218 may include accelerations 312 as well as derivatives or integrals of accelerations, such as, for example, velocity, jerk, jounce, snap . . . etc. The IMU sensor 218 is in communication with the controller 212 of the sensing apparatus 210.

The plurality of sensors 217 may also include additional sensors including but not limited to a light sensor 226, a pressure sensor 228, a microphone 230, a humidity sensor 232, and a temperature sensor 234. The light sensor 226 is configured to detect sensor data 202 including light exposure. The light sensor 226 is in communication with the controller 212. The pressure sensor 228 is configured to detect sensor data 202 including pressure data 314, such as, for example, atmospheric air pressure within the elevator shaft 117. The pressure sensor 228 may be a pressure altimeter or barometric altimeter in two non-limiting examples. The pressure sensor 228 is in communication with the controller 212. The microphone 230 is configured to detect sensor data 202 including audible sound and sound levels. The microphone 230 is in communication with the controller 212. The humidity sensor 232 is configured to detect sensor data 202 including humidity levels. The humidity sensor 232 is in communication with the controller 212. The temperature sensor 234 is configured to detect sensor data 202 including temperature levels. The temperature sensor 234 is in communication with the controller 212.

The controller 212 of the sensing apparatus 210 includes a processor 214 and an associated memory 216 comprising computer-executable instructions that, when executed by the processor 214, cause the processor 214 to perform various operations, such as, for example, processing the sensor data 202 collected by the IMU sensor 218, the light sensor 226, the pressure sensor 228, the microphone 230, the humidity sensor 232, and the temperature sensor 234. In an embodiment, the controller 212 may process the accelerations 312 and/or the pressure data 314 in order to determine a probable location of the elevator car 103, discussed further below. The processor 214 may be but is not limited to a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory 216 may be a storage device, such as, for example, a random access memory (RAM), read only memory (ROM), or other electronic, optical, magnetic or any other computer readable medium.

The power source 222 of the sensing apparatus 210 is configured to store and supply electrical power to the sensing apparatus 210. The power source 222 may include an energy storage system, such as, for example, a battery system, capacitor, or other energy storage system known to one of skill in the art. The power source 222 may also generate electrical power for the sensing apparatus 210. The power source 222 may also include an energy generation or electricity harvesting system, such as, for example synchronous generator, induction generator, or other type of electrical generator known to one of skill in the art.

The sensing apparatus 210 includes a communication module 220 configured to allow the controller 212 of the sensing apparatus 210 to communicate with the remote device 280 or controller 115 through at least one of short-range wireless protocols 203 and long-range wireless protocols 204. The communication module 220 may be configured to communicate with the remote device 280 using short-range wireless protocols 203, such as, for example, Bluetooth, Wi-Fi, HaLow (801.11ah), Wireless M-Bus, zWave, Zigbee, or other short-range wireless protocol known to one of skill in the art. Using short-range wireless protocols 203, the communication module 220 is configured to transmit the sensor data 202 to a local gateway device 240 and the local gateway device 240 is configured to transmit the sensor data to a remote device 280 through a network 250, as described above. The communication module 220 may be configured to communicate with the remote device 280 using long-range wireless protocols 204, such as for example, cellular, LTE (NB-IoT, CAT M1), LoRa, Ingenu, SigFox, Satellite, or other long-range wireless protocol known to one of skill in the art. Using long-range wireless protocols 204, the communication module 220 is configured to transmit the sensor data 202 to a remote device 280 through a network 250. In an embodiment, the short-range wireless protocol 203 is sub GHz Wireless M-Bus. In another embodiment, the long-range wireless protocol is Sigfox. In another embodiment, the long-range wireless protocol is LTE NB-IoT or CAT M1 with 2G fallback.

The sensing apparatus 210 includes a location probability module 330 configured to determine a probability of the elevator car 103 being at a plurality of possible destination locations along the elevator shaft 117. The probability of the elevator car 103 being at a plurality of possible destination locations along the elevator shaft 117 may be determined in response to a probable starting location and a distance traveled away from that probable starting location. The plurality of possible destination locations may be fixed locations along the elevator shaft 117, such as for example, the landings 125 of the elevator shaft 117. The locations may be equidistantly spaced apart along the elevator shaft 117 or intermittently spaced apart along the elevator shaft 117.

The location probability module 330 may utilize various approaches to determine a probability of the elevator car 103 being at a plurality of possible destination locations along the elevator shaft 117. In one example approach, the location probability module 330 may calculate probabilities independently for every start floor and then sum probabilities of end positions (i.e., destination location/landing/floor) with weights taken from start floors distribution. In another example approach, the location probability module 330 may calculate conditional probabilities for all combinations of start floor and destination floor.

The sensing apparatus 210 also includes a distance from acceleration derivation module 320 configured to determine a distance traveled of the elevator car 103 within the elevator shaft 117 in response to the acceleration of the elevator car 103 detected along the Y axis. The sensing apparatus 210 may detect an acceleration along the Y axis shown at 322 and may integrate the acceleration to get a velocity of the elevator car 103 at 324. At 326, the sensing apparatus 210 may also integrate the velocity of the elevator car 103 to determine a distance traveled by the elevator car 103 within the elevator shaft 117 during the acceleration 312 detected at 322. The direction of travel of the elevator car 103 may also be determined in response to the acceleration 312 detected. The location probability module 330 may then determine the probability of the elevator car 103 being at a plurality of possible destination locations along the elevator shaft 117 in response to a probable starting location and a distance traveled away from that probable starting location. The probable starting location may be based upon tracking the past operation and/or movement of the elevator car 103.

The sensing apparatus 210 may also include a distance from pressure derivation module 310. The sensing apparatus 210 may detect a change in pressure as the elevator car 103 is in motion using the pressure sensor 228. A distance traveled by the elevator car 103 within the elevator shaft 117 may be determined in response to the change in pressure via the pressure data 314 through either a look up table or a calculation of altitude using the barometric pressure change in two non-limiting embodiments. The direction of travel of the elevator car 103 may also be determined in response to the change in pressure detected via the pressure data 314. The location probability module 330 may then determine the probability of the elevator car 103 being at a plurality of possible destination locations along the elevator shaft 117 in response to a probable starting location and a distance traveled away from that probable starting location.

Figure 5:
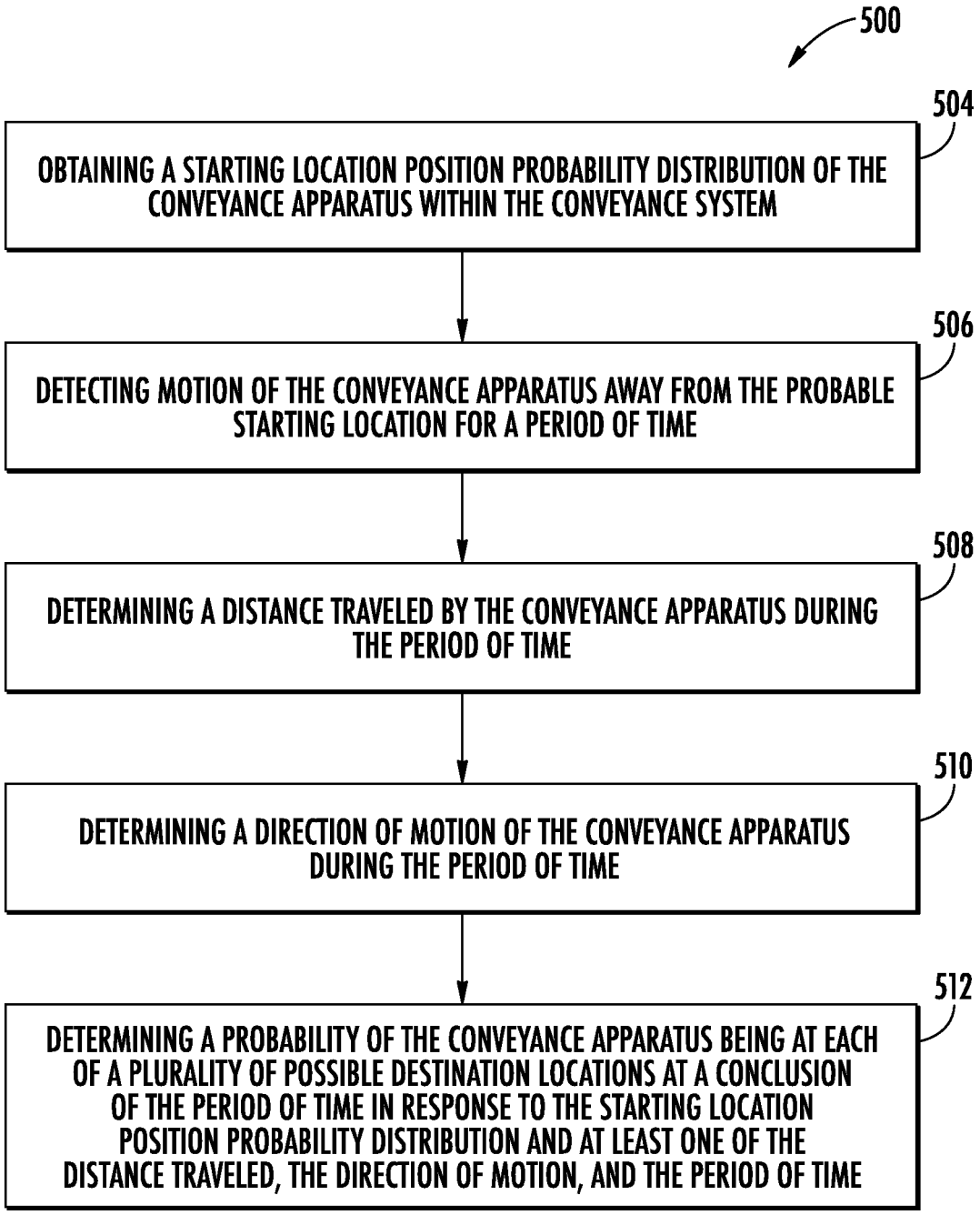
FIG. 5 is a flow chart of a method of monitoring a conveyance apparatus within a conveyance system, in accordance with an embodiment of the disclosure.

Referring now to FIG. 5, while referencing components of FIGS. 1-3. FIG. 5 shows a flow chart of a method 500 of monitoring a conveyance apparatus within a conveyance system, in accordance with an embodiment of the disclosure. In an embodiment, the conveyance system is an elevator system 101 and the conveyance apparatus is an elevator car 103. At block 504, a starting location position probability distribution of the conveyance apparatus within the conveyance system is obtained. For example, in an elevator system 101, the starting location position probability distribution will depict the probability that each landing 125 of an elevator system 101 may be the probable starting location. At block 506, motion of the conveyance apparatus away from the probable starting location for a period of time is detected.

At block 508, a distance traveled by the conveyance apparatus during the period of time is determined. In one embodiment, the distance traveled by the conveyance apparatus during the period of time may be determined by: detecting an acceleration of the conveyance apparatus during the period of time and determining the distance travelled by the conveyance apparatus in response to the acceleration and the period of time. In another embodiment, the distance traveled by the conveyance apparatus during the period of time may be determined by: detecting a first air pressure at the probable starting location of the conveyance apparatus; detecting a second air pressure at the conclusion of the period of time; and determining the distance travelled by the conveyance apparatus in response to the first air pressure and the second air pressure.

In another embodiment, the distance traveled by the conveyance apparatus during the period of time may be determined by: obtaining a velocity of the conveyance apparatus during the period of time; and determining the distance travelled by the conveyance apparatus in response to the velocity of the conveyance apparatus and the period of time. The velocity may be a standard operating velocity of the conveyance apparatus or a detected velocity. The sensing apparatus 210 may utilize a look up table for a distance travelled over the time period based upon the standard operating velocity of the conveyance apparatus or the detected velocity of the conveyance apparatus.

At block 510, a direction of motion of the conveyance apparatus during the period of time is determined. In one embodiment, the direction of motion of the conveyance apparatus may be determined in response to the acceleration of the conveyance apparatus detected during the period of time. In another embodiment, the direction of motion of the conveyance apparatus may be determined in response to the first air pressure and the second air pressure.

At block 512, a probability of the conveyance apparatus being at each of a plurality of possible destination locations at a conclusion of the period of time is determined in response to the starting location position probability distribution and at least one of the distance traveled, the direction of motion, and the period of time. A probable destination location may be determined amongst the plurality of possible destination location. The probable destination location may be a possible destination location of the plurality of possible destination locations having the probability that is highest amongst the plurality of possible destination locations.

In a first example, if the plurality of possible destinations of include five vertical landings and the distance traveled is two vertical landings upward, the probability of the bottom two landings being a probable destination location is low to zero, because the conveyance system cannot move up two landings to the bottom two vertical landings. Further, the probable starting location then may adjust the probability that one of the remaining three top landing is the probable destination.

The probabilities determined may be a weighted probability based on distance traveled. In another example, if hoistway is tall (e.g., landings 125 are spaced four meters apart) and a current location of the elevator car 103 is unknown then all floors may have same probability of being the probable starting location of the elevator car 103. If the elevator car 103 travels up about twenty meters then it may be determined that the top four landings 125 are less likely to be the start position as the elevator car 103 most likely not move upward 20 meters from any of the top four landings 125 if the landings 125 are spaced four meters apart. Therefore, the probability is lowest for top landing 125 and then the probability increases for the next three landings 125 moving away from the top landing 125.

An alert may be activated when the probability of the conveyance apparatus being at each of a plurality of possible destination locations at a conclusion of the period of time is less than a selected probability. If the probability of the conveyance apparatus being at each of a plurality of possible destination locations at a conclusion of the period of time is less than a selected probability then it may be understood that the sensing apparatus 210 is uncertain of a location of the conveyance apparatus. The alert may be an audible, visual, and/or vibratory alert on a computing device (e.g., remote device 280) to alert the user of the computing device that the sensing apparatus 210 is uncertain of a location of the conveyance apparatus.

The sensing apparatus 210 may perform a learning run and a learning mode. During a learning run, the sensing apparatus 210 is configured to define a floor map using just a sensing apparatus 210. The floor map may be utilized later by the sensing apparatus to apply probabilities. During a learning mode, the sensing apparatus 210 is learning the floor map of the elevator shaft 117 and assuming that the sensing apparatus 210 is constantly lost. For example, learning mode or learning run may start from a smallest determined elevator system (e.g., 2 stops). If the elevator car 103 moves upward it may be determined that the probability of a bottom landing 125 being the possible destination location is now about 0% and the probability of an upper landing 125 being the possible destination location is about 100%. Next, if elevator car 103 moves further up to stop at a second landing then it may be determined that at least three landings 125 exist along the elevator shaft 114. If the elevator car 125 then moves down to a third landing 125 but not as far as to reach the second landing 125 then it may be determined that there is a landing between the second landing and the third landing 125 and there are at least four landings 125. A new landing 125 may only be added if the new measured location is more than a selected distance away from a previously detected landing 125, which is to avoid detecting the same landing 125 and misinterpreting it as two different landings 125. The learning mode or learning run may continue until all the floors have been reached. The learning mode or learning run may end when each detected landing 125 has been visited twice or a specific motion of the elevator car 103 was detected (e.g., ex. one landing 125 up, two landings 125 down, one landing 125 up). Once the learning mode or learning run is completed then the probable starting location may be given a 100% probability.

While the above description has described the flow process of FIG. 5 in a particular order, it should be appreciated that unless otherwise specifically required in the attached claims that the ordering of the steps may be varied.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method of monitoring a conveyance apparatus within a conveyance system, the method comprising:

obtaining a starting location position probability distribution of the conveyance apparatus within the conveyance system;

detecting motion of the conveyance apparatus away from the probable starting location for a period of time;

determining a distance traveled by the conveyance apparatus during the period of time;

determining a direction of motion of the conveyance apparatus during the period of time; and determining a probability of the conveyance apparatus being at each of a plurality of possible destination locations at a conclusion of the period of time in response to the starting location position probability distribution and at least one of the distance traveled, the direction of motion, and the period of time.

2. The method of claim 1, wherein determining a distance traveled by the conveyance apparatus during the period of time further comprises:

detecting an acceleration of the conveyance apparatus during the period of time; and determining the distance travelled by the conveyance apparatus in response to the acceleration and the period of time.

3. The method of claim 1, wherein determining a distance traveled by the conveyance apparatus during the period of time further comprises:

obtaining a velocity of the conveyance apparatus during the period of time; and determining the distance travelled by the conveyance apparatus in response to the velocity of the conveyance apparatus and the period of time.

4. The method of claim 1, wherein obtaining a velocity of the conveyance apparatus during the period of time further comprises:

detecting a velocity of the conveyance apparatus during the period of time.

5. The method of claim 2, wherein the direction of motion of the conveyance apparatus is determined in response to the acceleration of the conveyance apparatus detected during the period of time.

6. The method of claim 1, wherein determining a distance traveled by the conveyance apparatus during the period of time further comprises:

detecting a first air pressure at the probable starting location of the conveyance apparatus;

detecting a second air pressure at the conclusion of the period of time; and determining the distance travelled by the conveyance apparatus in response to the first air pressure and the second air pressure.

7. The method of claim 1, further comprising:

activating an alert when the probability of the conveyance apparatus being at each of a plurality of possible destination locations at a conclusion of the period of time is less than a selected probability.

8. The method of claim 1, wherein the conveyance system is an elevator system and the conveyance apparatus is an elevator car.

9. The method of claim 1, further comprising:

determining the probable destination location, wherein the probable destination location is a possible destination location of the plurality of possible destination locations having the probability that is highest amongst the plurality of possible destination locations.

10. A sensing apparatus for monitoring a conveyance apparatus within a conveyance system, the sensing apparatus comprising:

a processor; and a memory comprising computer-executable instructions that, when executed by the processor, cause the processor to perform operations, the operations comprising:

determining a starting location position probability distribution of the conveyance apparatus within the conveyance system;

detecting motion of the conveyance apparatus away from the probable starting location for a period of time;

determining a distance traveled by the conveyance apparatus during the period of time;

determining a direction of motion of the conveyance apparatus during the period of time; and determining a probability of the conveyance apparatus being at each of a plurality of possible destination locations at a conclusion of the period of time in response to starting location position probability distribution and at least one of the distance traveled, the direction of motion, and the period of time.

11. The sensing apparatus of claim 10, wherein determining a distance traveled by the conveyance apparatus during the period of time further comprises:

detecting an acceleration of the conveyance apparatus during the period of time; and determining the distance travelled by the conveyance apparatus in response to the acceleration and the period of time.

12. The sensing apparatus of claim 10, wherein determining a distance traveled by the conveyance apparatus during the period of time further comprises:

obtaining a velocity of the conveyance apparatus during the period of time; and determining the distance travelled by the conveyance apparatus in response to the velocity of the conveyance apparatus and the period of time.

13. The sensing apparatus of claim 12, wherein obtaining a velocity of the conveyance apparatus during the period of time further comprises:

detecting a velocity of the conveyance apparatus during the period of time.

14. The sensing apparatus of claim 11, wherein the direction of motion of the conveyance apparatus is determined in response to the acceleration of the conveyance apparatus detected during the period of time.

15. The sensing apparatus of claim 10, wherein determining a distance traveled by the conveyance apparatus during the period of time further comprises:

detecting a first air pressure at the probable starting location of the conveyance apparatus;

detecting a second air pressure at the conclusion of the period of time; and determining the distance travelled by the conveyance apparatus in response to the first air pressure and the second air pressure.

16. The sensing apparatus of claim 10, wherein the operations further comprise:

activating an alert when the probability of the conveyance apparatus being at each of a plurality of possible destination locations at a conclusion of the period of time is less than a selected probability.

17. The sensing apparatus of claim 10, wherein the conveyance system is an elevator system and the conveyance apparatus is an elevator car.

18. The sensing apparatus of claim 10, wherein the operations further comprise:

determining the probable destination location, wherein the probable destination location is a possible destination location of the plurality of possible destination locations having the probability that is highest amongst the plurality of possible destination locations.

19. A computer program product tangibly embodied on a computer readable medium, the computer program product including instructions that, when executed by a processor, cause the processor to perform operations comprising:

determining a starting location position probability distribution of the conveyance apparatus within the conveyance system;

detecting motion of the conveyance apparatus away from the probable starting location for a period of time;

determining a distance traveled by the conveyance apparatus during the period of time;

determining a direction of motion of the conveyance apparatus during the period of time; and determining a probability of the conveyance apparatus being at each of a plurality of possible destination locations at a conclusion of the period of time in response to starting location position probability distribution and at least one of the distance traveled, the direction of motion, and the period of time.

20. The computer program product of claim 19, wherein determining a distance traveled by the conveyance apparatus during the period of time further comprises:

detecting an acceleration of the conveyance apparatus during the period of time; and determining the distance travelled by the conveyance apparatus in response to the acceleration and the period of time.

* * * * *